US008677718B2

(12) United States Patent
Marshall

(10) Patent No.: US 8,677,718 B2
(45) Date of Patent: Mar. 25, 2014

(54) RETROFIT MOUNTING CLIP FOR AN EXTERIOR BUILDING SURFACE

(76) Inventor: Joseph T. Marshall, Rathwell (CA)

( * ) Notice: Subject to any disclaimer, the term of this patent is extended or adjusted under 35 U.S.C. 154(b) by 0 days.

(21) Appl. No.: 13/462,010

(22) Filed: May 2, 2012

(65) Prior Publication Data

US 2012/0279165 A1 Nov. 8, 2012

Related U.S. Application Data

(60) Provisional application No. 61/481,326, filed on May 2, 2011.

(51) Int. Cl.
*E04H 12/00* (2006.01)

(52) U.S. Cl.
USPC ..... 52/655.1; 52/713

(58) Field of Classification Search
USPC ..... 52/655.1, 713, 702, 92.1, 92.2, 93.1
See application file for complete search history.

(56) References Cited

U.S. PATENT DOCUMENTS

| | | | | |
|---|---|---|---|---|
| 4,445,305 | A | 5/1984 | Orie, Sr. | |
| 4,516,371 | A | 5/1985 | Simpson | |
| 4,841,690 | A * | 6/1989 | Commins | 52/105 |
| 4,894,967 | A * | 1/1990 | Morton | 52/334 |
| 5,181,360 | A | 1/1993 | Shingler | |
| 5,555,694 | A * | 9/1996 | Commins | 52/702 |
| 6,240,682 | B1 | 6/2001 | James et al. | |
| 6,560,943 | B1 * | 5/2003 | Leek et al. | 52/715 |
| 6,931,813 | B2 * | 8/2005 | Collie | 52/713 |
| 7,861,480 | B2 * | 1/2011 | Wendelburg et al. | 52/483.1 |
| 2010/0275525 | A1 * | 11/2010 | Wendelburg et al. | 52/90.2 |
| 2011/0016803 | A1 | 1/2011 | Ray | |

* cited by examiner

*Primary Examiner* — Basil Katcheves
(74) *Attorney, Agent, or Firm* — Ryan W. Dupuis; Kyle R. Satterthwaite; Ade & Company Inc.

(57) ABSTRACT

A replacement exterior surface, for example a replacement roof, is supported by a retrofit system including wooden structural members of dimensional lumber and mountings clips, so as to span over an existing exterior supporting surface of a building, for example an existing roof. The mounting clips each have a base portion for being fastened through the exterior supporting surface onto respective underlying structural members of the building and a channel portion receiving a respective portion of the wooden structural members therein. The mounting clips are arranged to support the wooden structural members to span parallel and spaced apart from one another in a substantially common plane outwardly from the exterior supporting surface of the building for supporting the replacement exterior surface material thereon.

20 Claims, 15 Drawing Sheets

RETROFIT MOUNTING CLIP FOR AN EXTERIOR BUILDING SURFACE

This application claims the benefit under 35 U.S.C. 119(e) of U.S. provisional application Ser. No. 61/481,326, filed May 2, 2011.

FIELD OF THE INVENTION

The present invention relates to a mounting clip for supporting a retrofit exterior surface over an existing exterior surface of a building, for example a mounting clip of the type used for supporting retrofit purlins above an existing roof surface such that a replacement roof can be supported on the retrofit purlins.

BACKGROUND

In retrofitting buildings, it is common to replace various exterior surfaces with replacement surfaces, for example for improving the condition of the building or for improving the insulation value thereof. Building roofs in particular are commonly retrofitted by laying replacement roofing material overtop of existing roofing material. Depending upon the existing exterior material on the building however, it can be difficult to adequately support a replacement exterior surface on a building.

U.S. Pat. No. 5,181,360 by Shingler, U.S. Pat. No. 4,516,371 by Simpson, U.S. Pat. No. 4,445,305 by Orie, Sr., and U.S. Pat. No. 6,240,682 by James et al, as well as United States Patent Application Publication Nos. US2010/0275525 by Wendelburg et al and US2011/0016803 by Ray disclose various configurations of retrofit roofs which provide some space for additional insulation above the existing supporting surface of the building. Known retrofit system are generally limited to use with standing seam roofing material such that they are considerably limited in application.

SUMMARY OF THE INVENTION

According to one aspect of the invention there is provided a retrofit system for an exterior portion of a building in which the exterior portion of the building comprises a plurality of main structural members spanning parallel and spaced apart from one another and an exterior supporting surface spanning an outer side of the main structural members, the system comprising:

a plurality of wooden structural members of dimensional lumber; and a plurality of mounting clips arranged to be supported at spaced positions along each wooden structural member, each mounting clip comprising:

- a base portion including at least one mounting flange arranged to be fastened to a respective one of the main structural members through the exterior supporting surface of the building; and
- a channel portion supported on the base portion and arranged to matingly receive a portion of the respective wooden structural member therein such that the wooden structural members are arranged to be supported parallel and spaced apart from one another in a substantially common plane spanning the exterior supporting surface of the building.

The use of a channel portion which accepts a wooden structural member allows the retrofit mounting clips of the present invention to be used for supporting various configurations of wooden structures outwardly from an existing exterior supporting surface on a building. Accordingly the clips are well suited for use on retrofitting the exterior of walls as well as roofs of a building. Furthermore the use of a channel portion for accommodating a wooden structural member allows the retrofit exterior surface to use conventional lumber and conventional wood screws which can be fastened more securely and at less cost that metal screws commonly required in the prior art retrofit systems.

Preferably the channel portion comprises a hook portion oriented substantially parallel to the base portion at a location spaced outwardly from the base portion so as to be arranged for abutment with an outer side of the wooden structural member when the wooden structural member is engaged within the channel portion.

Preferably the channel portion further comprises a connecting portion extending between the base portion and one side of the hook portion and an end portion extending inwardly from the other side of the hook portion so as to be arranged to receive the wooden structural member between the connecting portion and the end portion of the channel portion when the wooden structural member is engaged within the channel portion.

The hook portion may comprise a pair of flanges which are spaced apart from one another to define an opening therebetween which is arranged to span a full width of a wooden structural member received in the channel portion.

The channel portion may further include an end portion joined between the flanges spaced from the connecting portion so as to be arranged to receive the wooden structural member between the connecting portion and the end portion of the channel portion when the wooden structural member is engaged within the channel portion.

When the connecting portion and the end portion include an outer edge forming a portion of a perimeter of the opening in the hook portion, preferably the outer edges are recessed inwardly relative to the hook portion.

The channel portion may include fastener apertures formed therein so as to be arranged to receive fasteners extending therethrough into the wooden structural member. More particularly, the fastener apertures may be located in the hook portion, an end portion of the channel, or the connecting portion of the channel portion.

The clip may be used in combination with an exterior supporting surface of a building comprising an exterior layer of a roof in which the main structural members comprise purlins of the roof. In this instance the base portion is fastened onto a respective one of the purlins through the exterior layer. The wooden structural member received in the channel portion may extend parallel or perpendicularly to the purlins depending upon the desired replacement surfacing material to be supported and the amount of insulation spaced desired between the new and old surfacing material.

When primary wooden structural members are received in the channel portions of a plurality of retrofit mounting clips of like configuration so as to be supported parallel and spaced apart from one another above the exterior roof layer, a plurality of secondary wooden structural members may span perpendicularly across the primary wooden structural members.

When the hook portion comprises a pair of flanges which are spaced apart from one another to define an opening therebetween, preferably the opening receives one of the secondary wooden structural members therein such that the respective primary and secondary wooden structural members are fastened together in direct contact with one another.

Alternatively, the clip may be used on the exterior supporting surface of a building comprising an exterior layer of a wall in which the main structural members comprise vertical studs of the wall. In this instance the base portion is preferably fastened onto a respective one of the studs through the exterior layer such that the wooden structural members received in the channel portions extend vertically and parallel to the studs.

In alternative embodiments of the clip, each clip may further comprise a standing portion extending from the base portion outwardly and away from the exterior supporting surface such that the channel portion is coupled to the standing portion spaced outwardly from the base portion. In this instance the base portion may comprise plurality of flanges locating mounting apertures therein which protrude laterally outwardly from an inner end of the standing portion. Furthermore, the channel portion may comprise a supporting portion oriented substantially parallel to the base portion so as to be arranged for abutment with an inner side of the wooden structural member when the wooden structural member is engaged within the channel portion.

According to a second aspect of the present invention there is provided a method of supporting a retrofit exterior surface on a building comprising a plurality of main structural members spanning parallel and spaced apart from one another and an exterior supporting surface spanning an outer side of the main structural members, the method including:

providing a plurality of mounting clips comprising:

a base portion including at least one mounting flange; and a channel portion supported on the base portion;

fastening the mounting flanges of the mounting clips through the exterior supporting surface onto respective ones of the structural members such that the channel portions project outwardly from the exterior supporting surface of the building; and mounting a plurality of wooden structural members within the channel portions of the mounting clips such that the wooden structural members span parallel and spaced apart from one another in a substantially common plane spaced outwardly from the exterior supporting surface of the building.

According to a third aspect of the present invention there is provided a retrofit mounting clip for supporting a wooden structural member comprising dimensional lumber so as to be substantially parallel and spaced outwardly from an exterior supporting surface spanning main structural members in a building, the clip comprising:

a base portion including at least one mounting flange arranged to be fastened onto the exterior supporting surface of the building;

a standing portion extending outwardly from the base portion; and a channel portion supported on the standing portion spaced outwardly from the base portion, the channel portion being arranged to receive wooden structural member therein.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
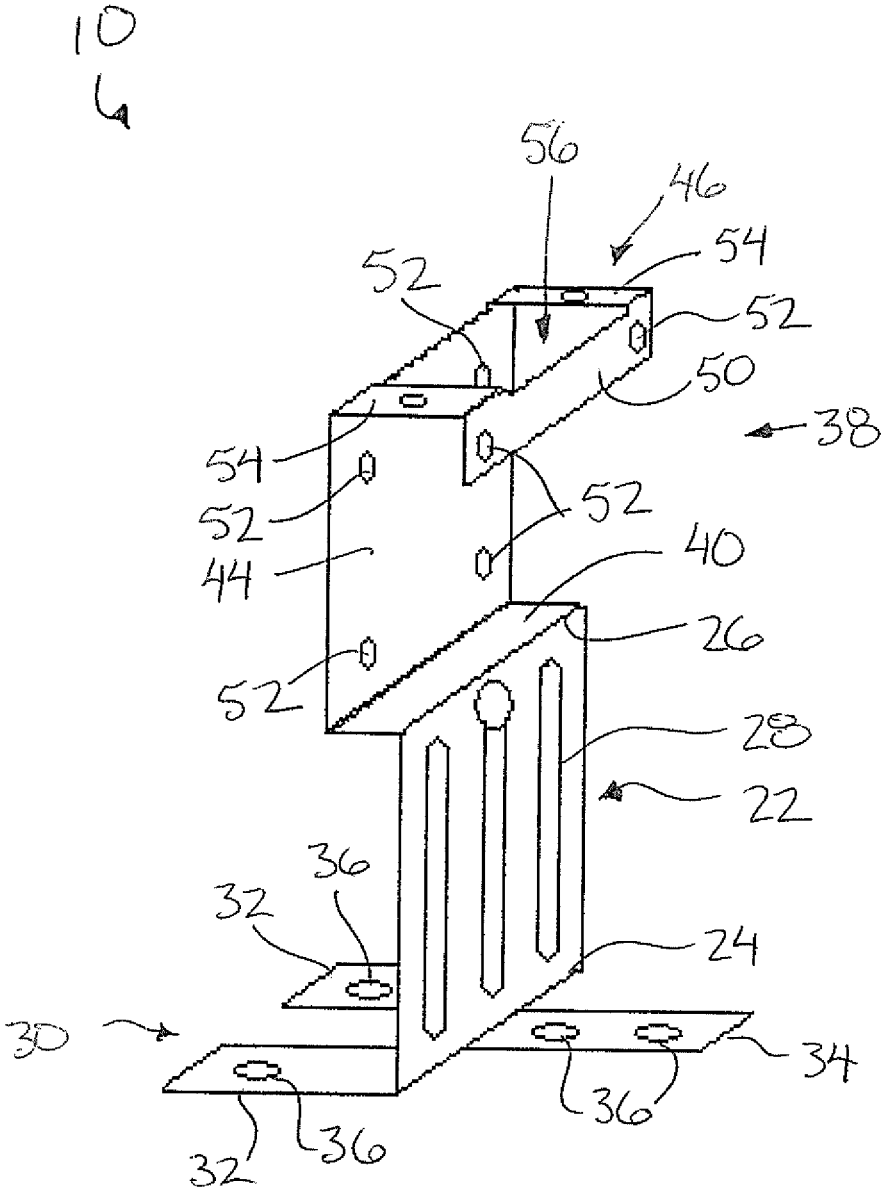
FIG. 1 is a perspective view of a first embodiment of the retrofit mounting clip.

Referring to the accompanying figures, there is illustrated a retrofit mounting clip generally indicated by reference numeral 10. The clip 10 is particularly suited for supporting a retrofit exterior surface over an existing exterior surface of a building.

In a typical building construction, the existing exterior supporting surface 12 of the building spans over main structural numbers 14 which are parallel and spaced apart from one another. In the example of a roof, the exterior supporting surface 12 comprises an exterior layer of the roof such as standing seam roofing material or a layer of exterior sheathing with exterior finishing materials such as shingles and the like thereon. The main structural members in this instance comprise purlins such as steel I-beams or Z-channels in commercial buildings. Alternatively, in the example of a wall, the exterior layer forming the exterior supporting surface typically comprises sheathing including finishing material for example stucco thereon. The main structural members in this instance typically comprise vertical studs within the wall structure.

Figure 5:
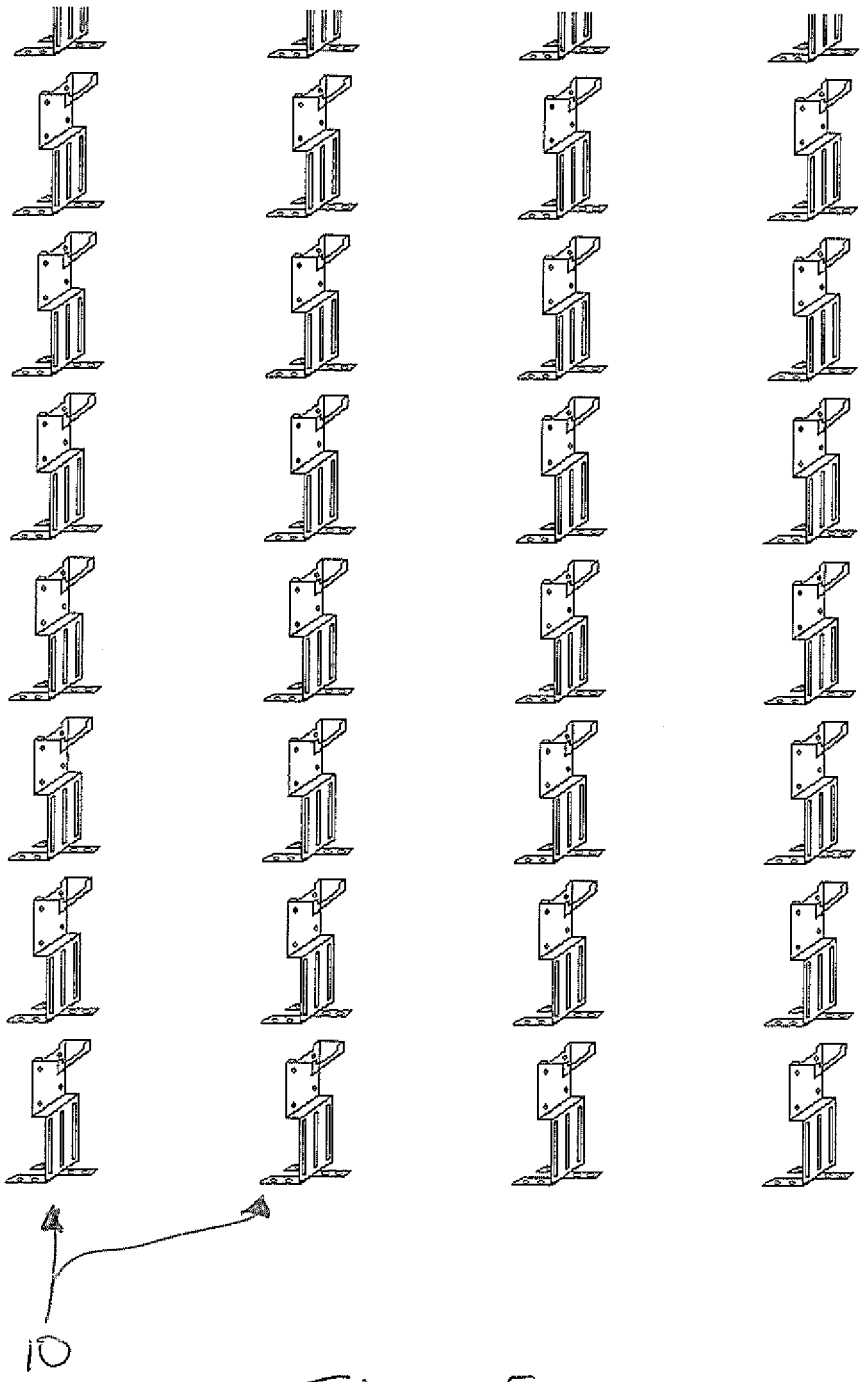
FIG. 5 is a schematic representation of an array of clips according to FIG. 1 supported on the exterior surface of a building.
Figure 6:
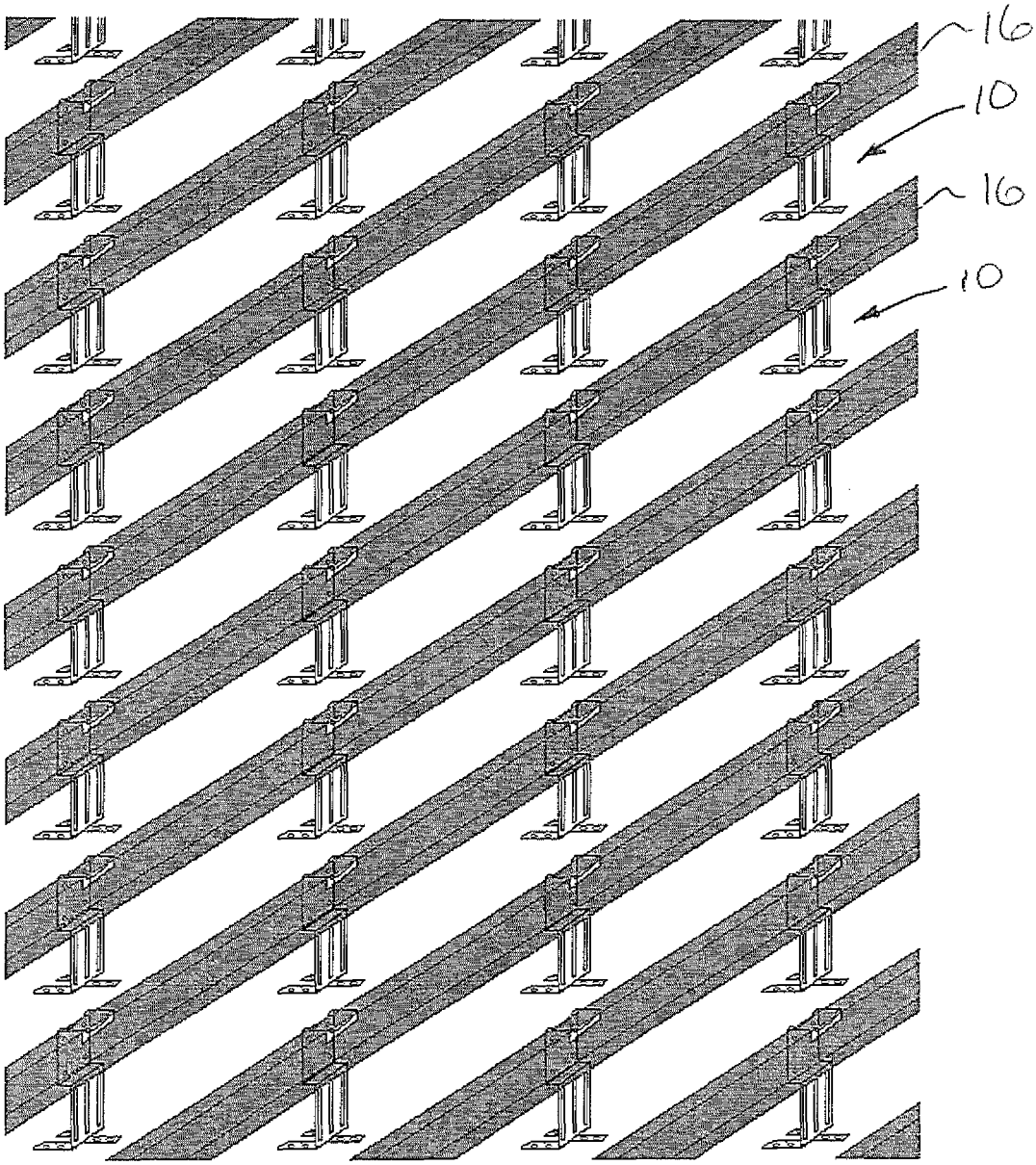
FIG. 6 is a schematic representation of primary wooden structural members supported on the array of clips of FIG. 5.
Figure 7:
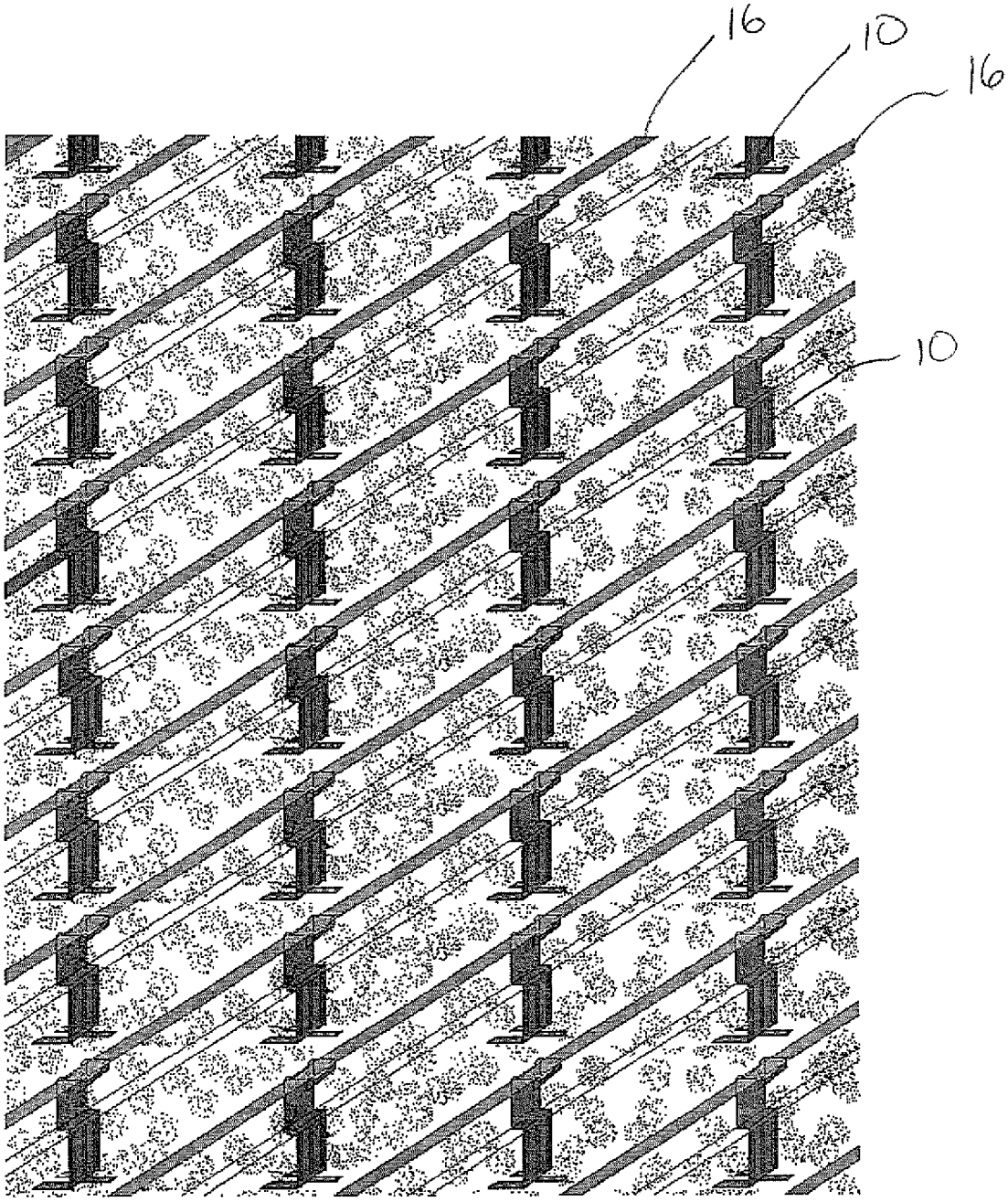
FIG. 7 is a schematic representation of bats of insulation received between the primary wooden structural members of FIG. 6.

In either instance, the clips 10 are mounted in an array as shown in FIG. 5 such that the clips are longitudinally spaced apart within longitudinal rows and such that the rows are in turn laterally spaced apart and parallel to one another. The clips are fastened with suitable fasteners which extend through the exterior layer of the building for securement to the main structural members therebelow. One row of clips is mounted along each of the main structural members of the building.

The clips 10 serve to support a plurality of primary wooden structural members 16 such that each primary member spans a plurality of the clips and such that the primary members are parallel and spaced apart from one another to span across the exterior surface of the building in a substantially common plane which is spaced outwardly from the surface of the building. The primary members typically comprise commercially available dimensioned lumber, for example wooden 2×4's of rectangular cross section so as to have a thickness in one direction of approximately 1.5 inches and a thickness in the transverse direction of approximately 3.5 inches.

The layer of primary members 16 allows support of an additional layer of secondary wooden structural members 18 as desired in some applications. The secondary members are similarly mounted in a common plane parallel and spaced apart from one another. Each secondary member spans perpendicularly across a plurality of primary members 16 in direct abutment with the primary members for direct fastening with suitable wood screws therebetween. Retrofit sheathing 20 for roofs or walls can then be mounted to span across the secondary members to support any desired exterior finishing material thereon such as shingles, torch down roofing, stucco or siding.

In some embodiments, no secondary wooden structural members are required such that finishing materials such as standing seam roofing material can be supported directly on the primary members 16.

Each clip 10 is formed of a single integral and seamless sheet metal member. The sheet metal member is typically cut with suitable punching equipment prior to being folded into the desired finished shape shown in the Figures.

Turning now to the first embodiment of FIG. 1, each clip generally includes a standing portion 22 comprising a flat rigid rectangular sheet spanning in a first direction between an inner end 24 and an outer end 26. Slots 28 may be formed in the standing portion to extend in the first direction for reducing the material used without substantially compromising the standing strength of the standing portion 22.

The clip further comprises a base portion for being joined to the standing portion at the inner end thereof. In particular, the base portion comprises two side mounting flanges 32 and one central mounting flange 34 oriented perpendicularly to the first direction of the standing portion and locating fastener apertures 36 therein such that the mounting flanges are arranged to receive fasteners therethrough for screwing or bolting the flanges parallel and flat against the exterior supporting surface of the building. The two side flanges are spaced apart in a second direction transverse to the first direction for locating the central flange 34 therebetween. The two side flanges project outwardly from one side of the standing portion while the central flange extends outward from the standing portion in the opposing direction for optimal strength in supporting the standing portion to project substantially perpendicularly outward from the exterior supporting surface of the building upon which the clip is mounted.

Each clip further comprises a channel portion 38 mounted onto the outer end 26 of the standing portion so as to be spaced outwardly from the base portion 30. The channel portion includes a supporting flange 40 parallel and spaced outwardly from the base portion so as to be perpendicular to the standing portion. The supporting flange 40 extends outward in one direction from one side of the standing portion to define a shelf upon which an inner edge 42 of a respective one of the primary wooden structural members is arranged to be engaged when the structural member is received within the channel.

Each channel portion 38 further comprises a connecting flange 44 connected to the supporting flange 40 along the opposing edge from the standing portion such that the connecting flange extends outward parallel to the standing portion and perpendicularly to the base portion. The connecting flange 44 also comprises a rectangular flat and rigid flange which is arranged to extend along one side of the primary wooden structural member received in the channel between the inner and outer edges thereof.

The channel portion 38 further comprises a hook flange 46 which is parallel to the supporting flange and is spaced outwardly therefrom by a distance corresponding approximately to the thickness of the primary wooden structural member between the inner and outer edges thereof. The hook flange extends laterally to one side of the connecting flange in the direction of the supporting flange so as to be suitably oriented for extending over and engaging the outer edge 48 of the respective primary wooden structural member received in the channel. The space between the hook flange and the supporting flange may be such that the primary wooden member is snugly received therebetween.

In some instances, the hook flange may be permitted some flexing relative to the connecting flange to assist in negotiating the primary wooden structural member into the channel of the clip. To facilitate mounting of the primary member into the channel, the width of the supporting flange 40 between the standing portion and the connecting flange may correspond to only approximately half of the width of the primary member at the inner edge thereof. The hook flange 46 typically spans the full width of the outer edge of the primary member between opposing edges thereof.

The channel portion further comprises an end flange 50 which extends inward from the edge of the hook flange 46 opposite to the connecting flange 44. The end flange extends inward towards the base portion of the clip so as to be arranged to overlap one side of the primary wooden structural member opposite the connecting flange. The end flange has a height in the first direction which is much shorter than the connecting flange 44 such that the end flange extends only part way towards the inner end of the connecting flange connected to the supporting flange. The remaining space between the free end of the end flange and the supporting flange provides access for insertion of the primary wooden structural member therethrough into the channel.

Typically, the primary member is inserted into the channel portion of the clip by engaging the outer edge outwardly into engagement with the underside of the hook flange prior to rotating the primary member until the inner edge thereof is aligned overtop of the supporting flange and one side of the member abuts the connecting flange. Fastener apertures 52 are provided in each of the connecting flange, the hook flange and the end flange which permit insertion of fasteners therethrough for direct fastening into the wooden structural member. In this manner, the wooden structural member may be readily fastened and secured to the clips using conventional wood fasteners without any self-tapping metal screws being required as in many prior art clip configurations.

The hook flange 46 typically comprises two separate side flanges 54 lying in a substantially common plane but spaced apart from one another in the second direction by an opening 56 therebetween. The opening spans the full width of the hook flange between the connecting flange and the end flange while spanning in the second direction a width which is equal to or greater than the height of the connecting flange between the supporting flange and the hook flange. In this instance, the dimensioned lumber that fits within the channel portion of the clip can also be used as the secondary wooden structural members by laying the members flat with their widest thickness being oriented in the second direction of the primary wooden structural members while still being received between the two side flanges 54 defining the hook flange 46. This permits direct wood to wood contact between the primary and secondary wooden structural members for ease of fastening therebetween with conventional wooden screw fasteners.

To further ensure direct wood to wood contact, the outer edges of the end flange and connecting flange which define a portion of the perimeter about the opening 56 are recessed inwardly towards the base portion by the thickness of the hook flange or greater. Accordingly, the outer edges of the connecting flange and the end flange do not interfere with direct contact between the primary and secondary wooden structural members.

Figure 2:
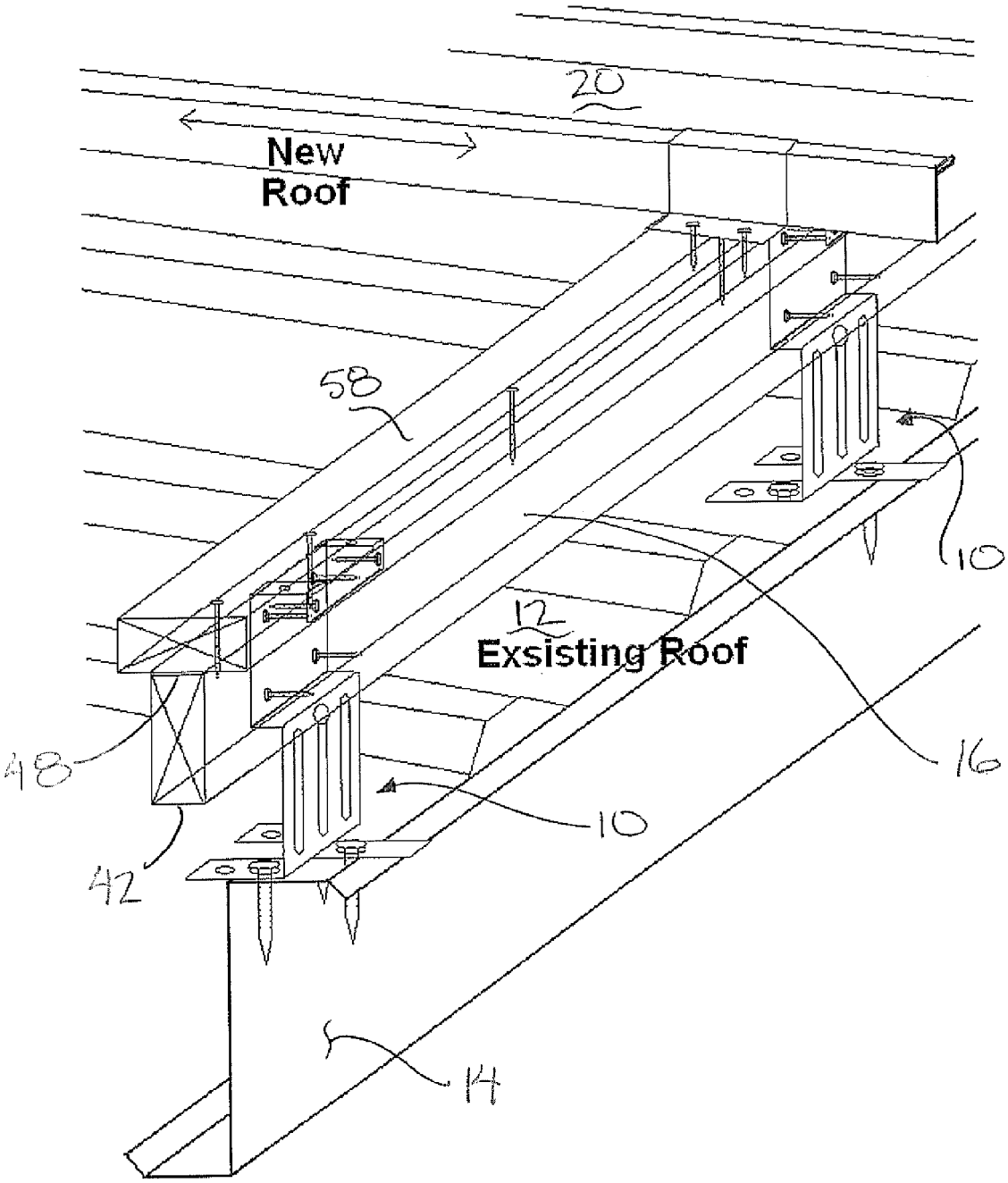
FIG. 2 is a perspective view of the installation of the retrofit mounting clip according to FIG. 1 for supporting standing seam roofing directly on the primary wooden structural members received in the clips.

As shown in a typical roof installation, the clips 10 are first installed in array as shown in FIG. 5 with a row of clips being fastened along each of the main structural members or purlins of the roof. Typically the channels are oriented so that the primary wooden structural members received therein are oriented in the direction of the purlins when it is the intention to also mount secondary structural members on the primary structural members. Alternatively when supporting retrofit roofing material directly on the primary wooden structural members, the clips can instead be oriented with the channels allowing the primary members to extend parallel to the roof purlins as shown in FIG. 2.

Once the clips have been installed, the primary wooden structural members are inserted within the respective channel portions of the respective clips and are secured therein by fasteners extending through the apertures in the channel.

Figures 4A, 4B, 4C, 4D:
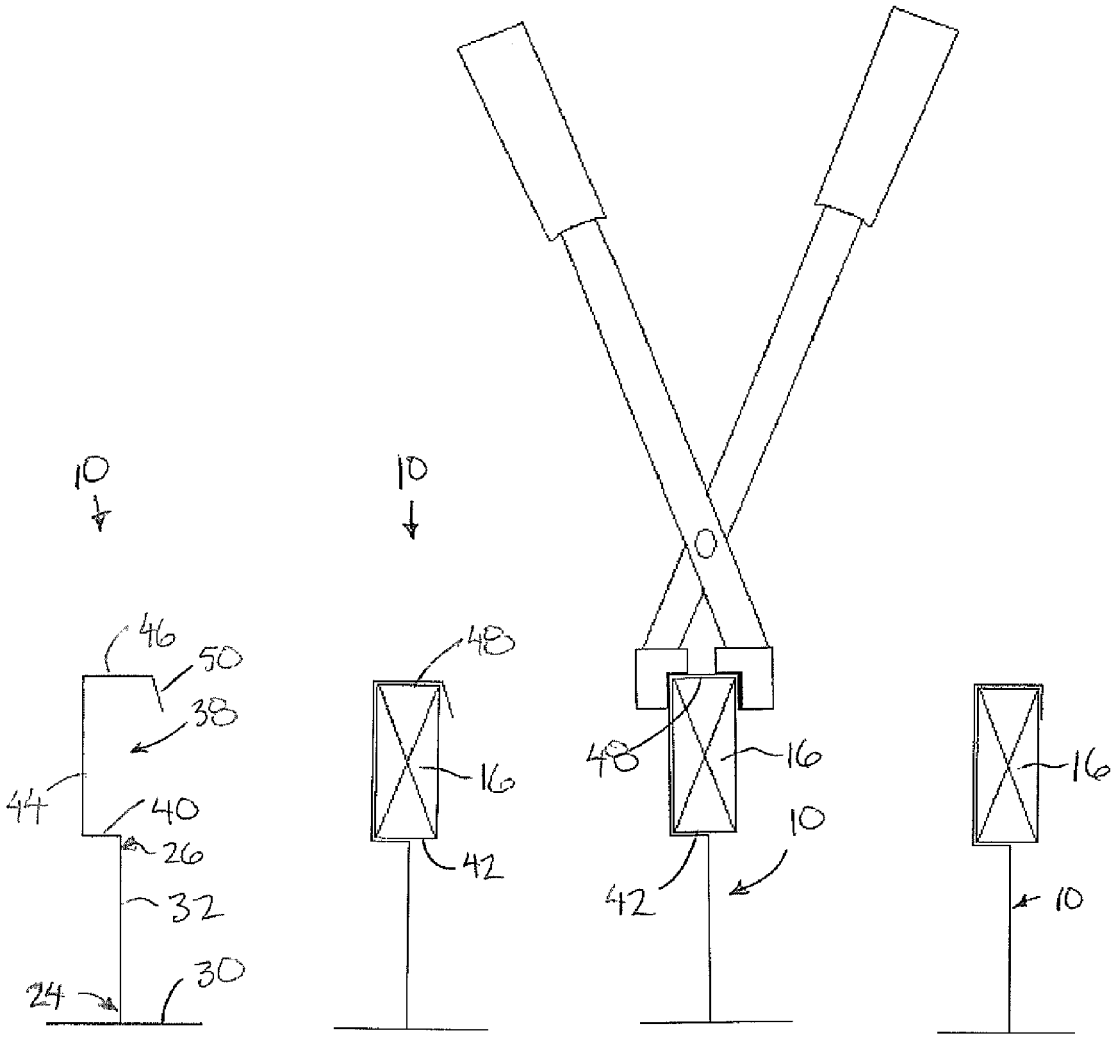
FIGS. 4A through 4D are sequential steps of the channel portion of a clip according to FIG. 1 being clamped about a respective primary wooden structural member.

Optionally for ease of insertion of the primary members into the channels and for better securement once inserted, the end flanges may initially be formed to project at an inclination away from the connecting flange as the end flange extends inwardly towards the base portion. This increases the opening between the end flange and the supporting flange to accommodate insertion of the primary wooden structural member therein as shown in FIGS. 4A and 4B. A suitable clamping tool may then be used to bend the end flange into an installed position parallel to the connecting flange and extending in abutment along one side of the primary member received therein, as shown in FIG. 4C. Once formed into the desired configuration of FIG. 4D, the fasteners can then be used to secure the end flange to the primary member.

Once the array of primary members are mounted in the clips, it is typically desirable to lay rows of insulation between the primary wooden structural members. The insulation is typically available in rolled bats which are simply unrolled in the direction of the primary wooden structural members. The primary structural members are typically located as a spacing corresponding to a commercial available width of insulation.

Figure 8:
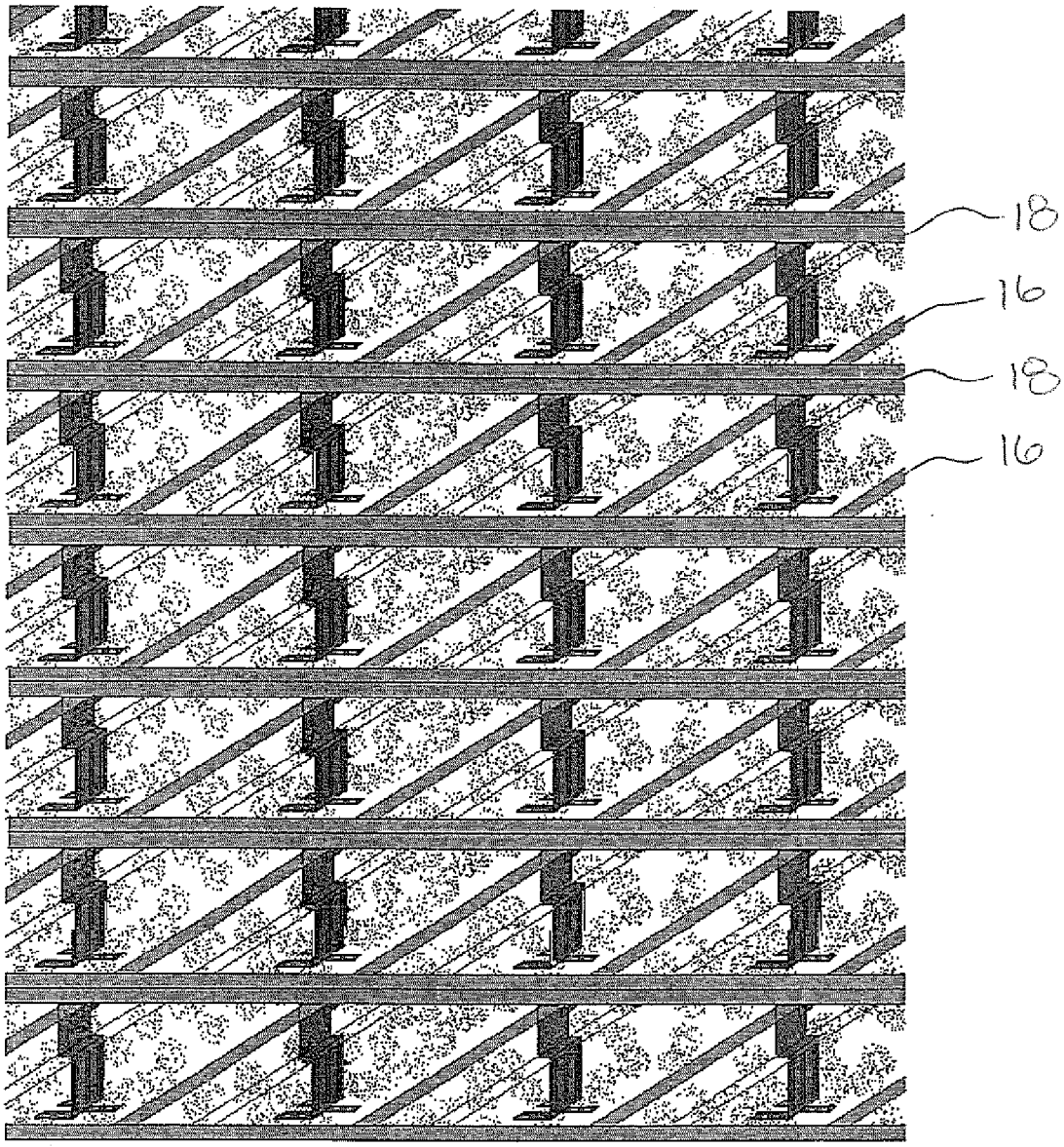
FIG. 8 is a schematic representation of secondary wooden structural members spanning over the insulation and primary wooden structural members of FIG. 7.
Figure 9:
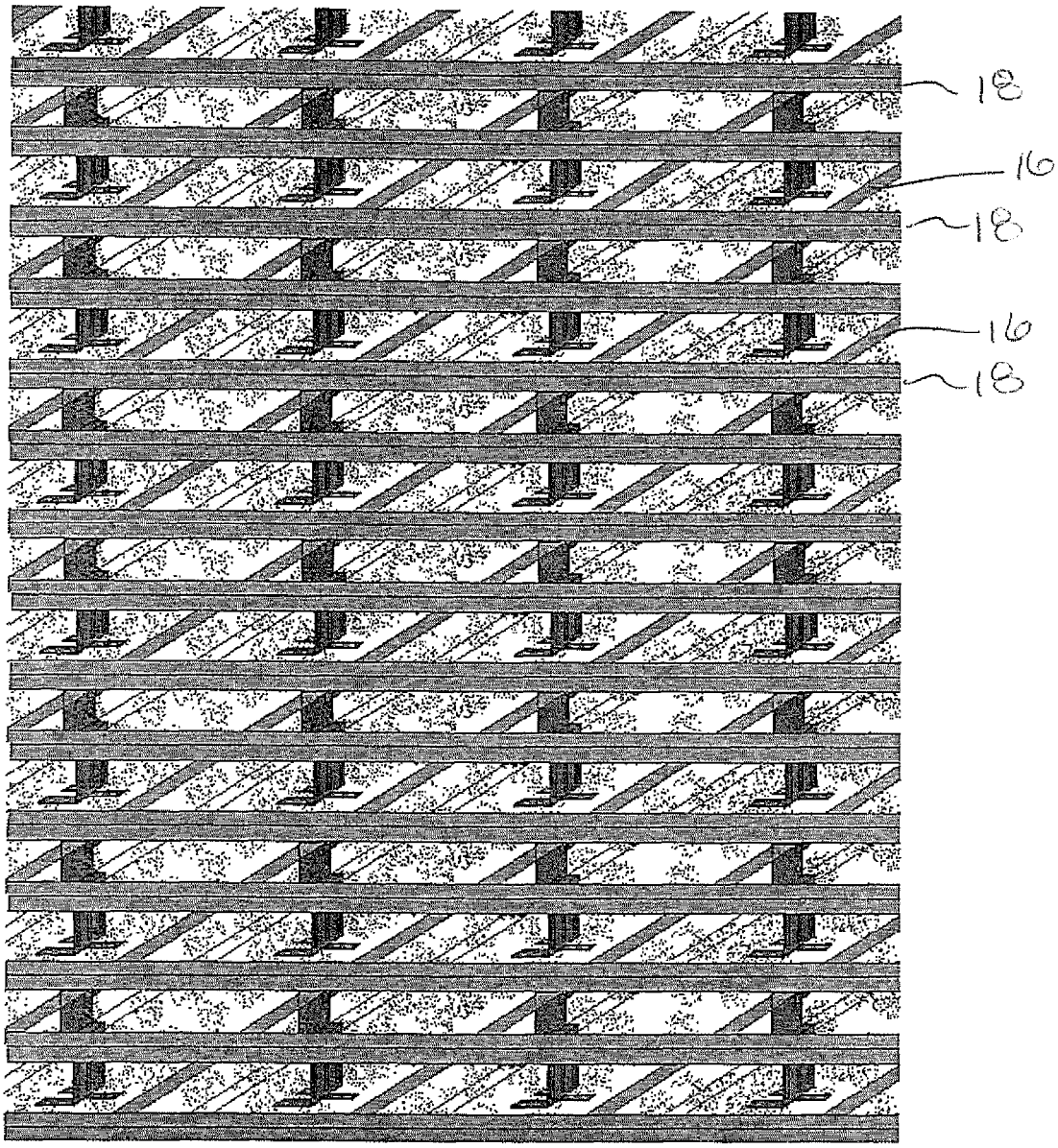
FIG. 9 is a schematic representation of additional wooden structural members spanning over the insulation and primary wooden structural members at intermediate positions between the secondary wooden structural members of FIG. 8.
Figure 10:
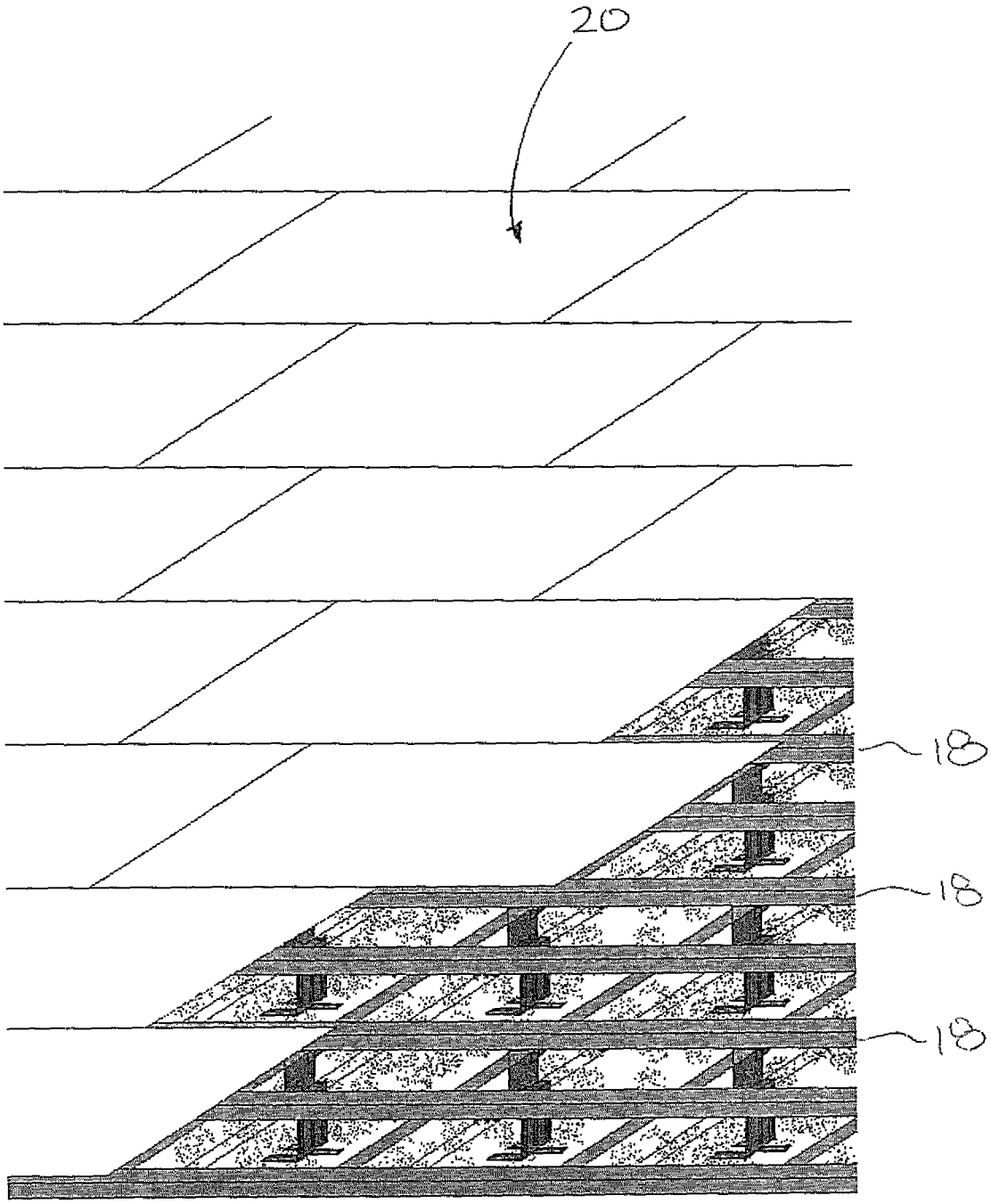
FIG. 10 is a schematic representation of a sheathing layer spanning over the secondary wooden structural members of FIGS. 8 and 9.
Figure 11:
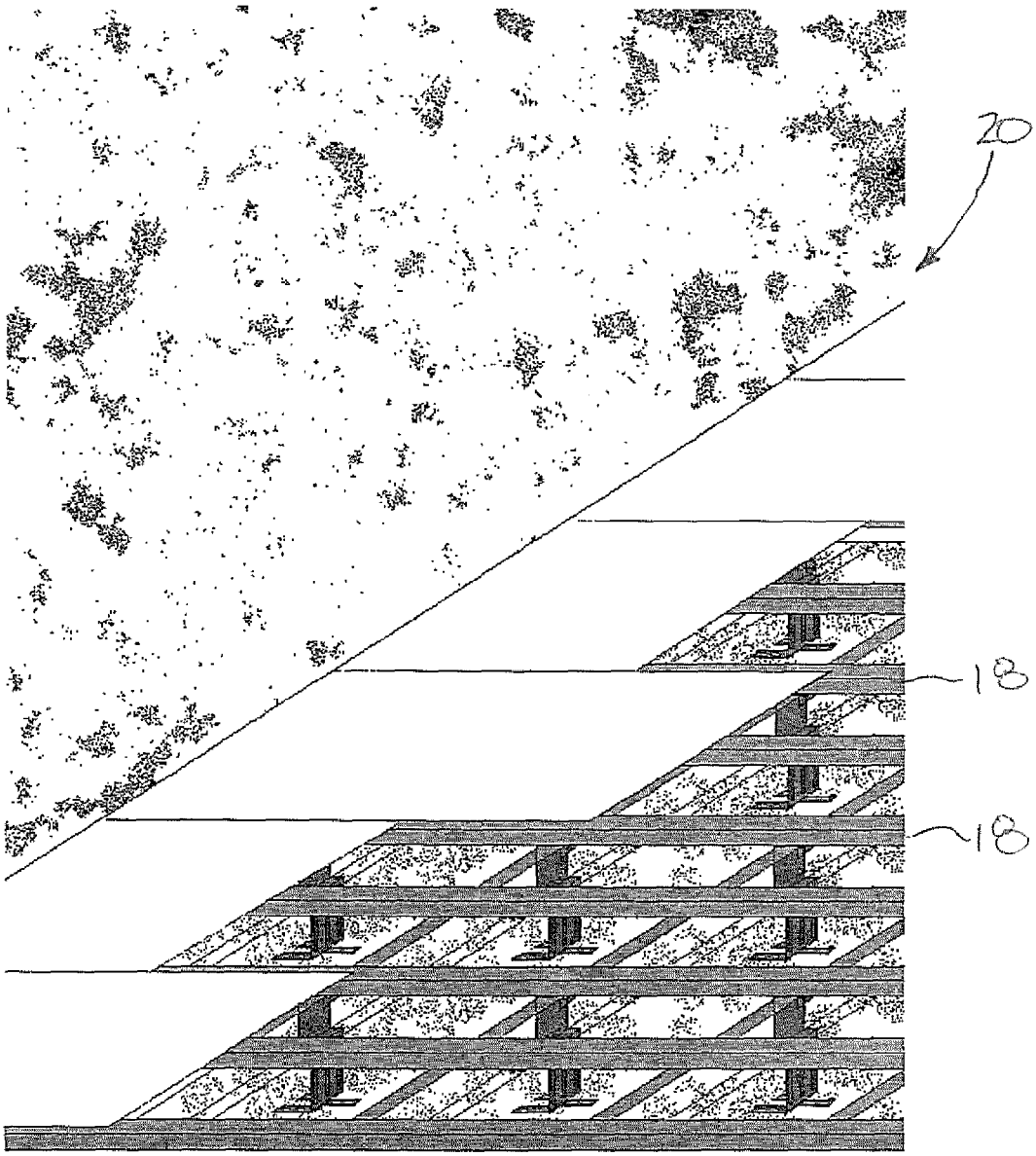
FIG. 11 is a schematic representation of an exterior layer of roofing material spanning over the sheathing layer of FIG. 10.
Figure 12:
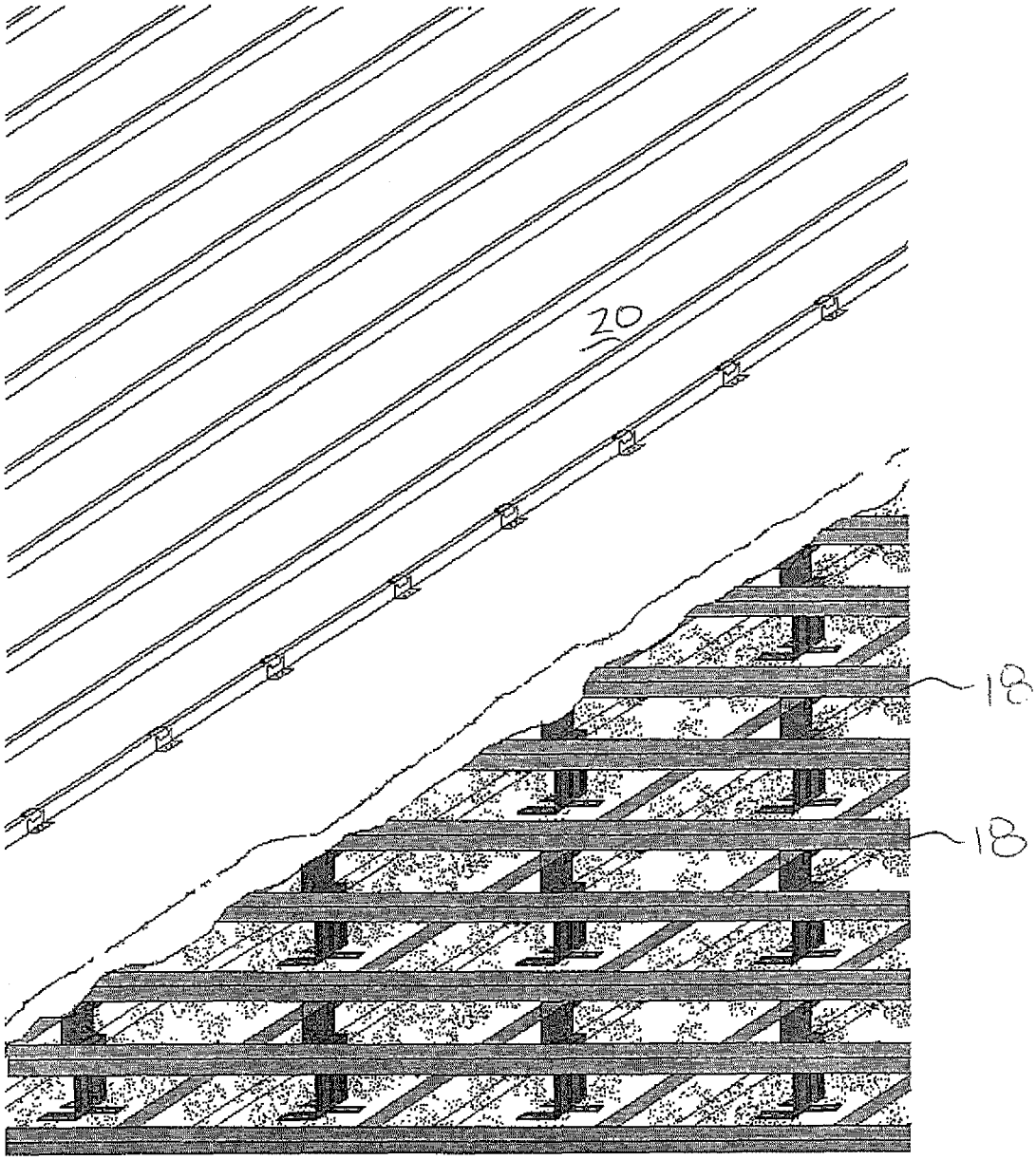
FIG. 12 is a schematic representation of standing seam roofing material spanning over the secondary wooden structural members of FIGS. 8 and 9.

If using secondary wooden structural members, the secondary members are then mounted across the primary structural members as shown in FIG. 8. Each secondary member intersects one of the primary members across which it spans at a location of one of the clips such that the primary and secondary wooden structural members abut one another through the opening in the hook flange of the clip. The direct coupling between the primary and secondary wooden structural members thus further ensures a fixed relationship between the wooden structural members and the clip received therebetween.

Where it is desired for the retrofit structure to have a narrower spacing between adjacent secondary structural members than the spacing between the original purlins to which the clips are fastened, auxiliary wooden structural members can be mounted parallel to the secondary structural members in a common plane therewith such that each auxiliary member is centrally located between an adjacent pair of secondary structural members. The sheathing can then be mounted overtop of the secondary and auxiliary structural members together for supporting finishing materials such as torch gown roofing as shown in FIGS. 10 and 11. Alternatively, standing seam roofing material can span the wooden structural members using conventional standing seam clips as shown in FIG. 12. By providing auxiliary secondary wooden structural members, the retrofit standing seam roofing material of FIG. 12 is permitted to be a weaker gauge than what would have been permitted on the original roof supported on the original purlins at greater spacing than the wooden structural members.

When fastening the replacement roofing material directly to the primary wooden structural members, the strength of the primary members can be increased by fastening further auxiliary structural member along side the primary structural member. As shown in FIG. 2, the auxiliary wooden member 58 in this instance is mounted to form a T-shaped cross section with the primary structural member to increase the beam strength thereof as well as provide a wider upper surface to which roofing clips can be attached.

The mounting clips according to FIG. 1 are particularly suited for retrofit installations in which additional insulation space is desired.

Figure 3:
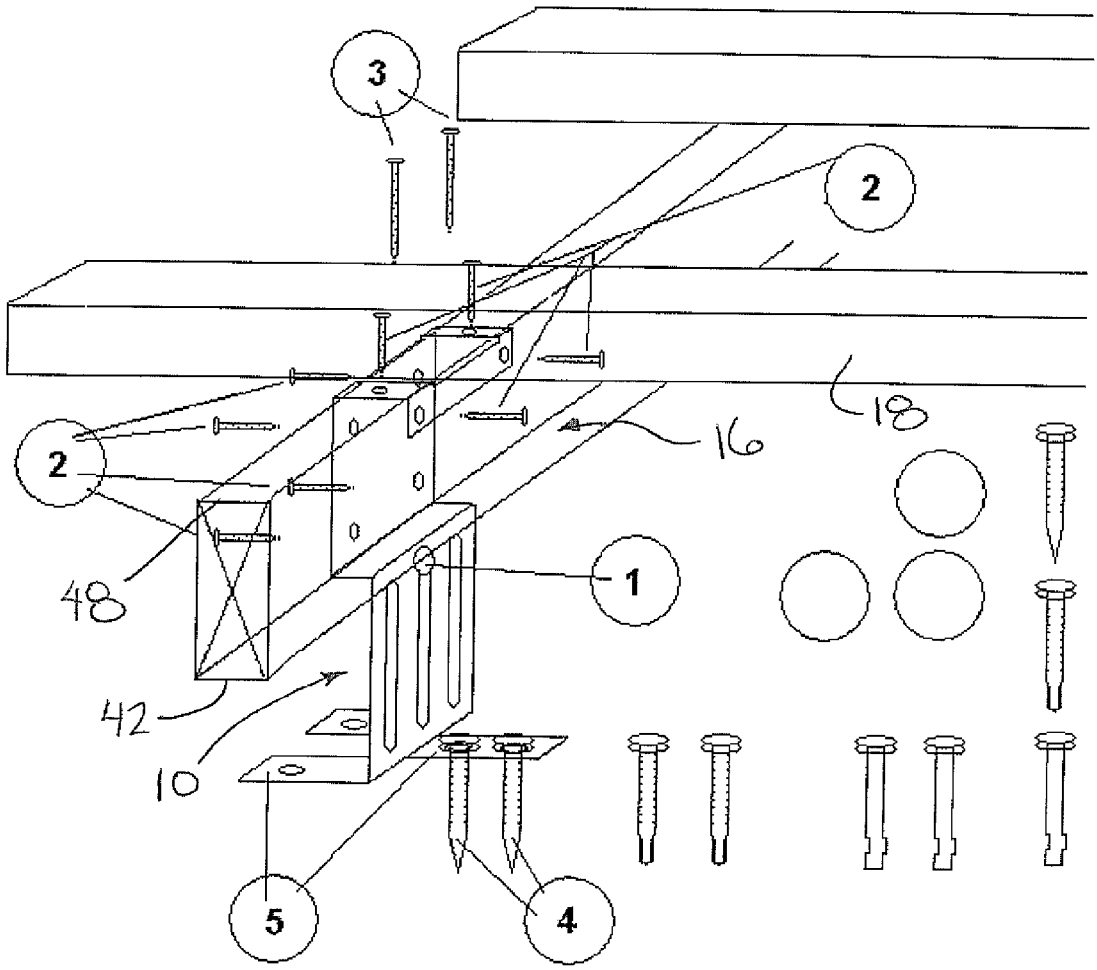
FIG. 3 is a perspective view of the installation of the retrofit mounting clip according to FIG. 1 for supporting secondary wooden structural members overtop of the primary wooden structural members received in the clips.
Figure 13:
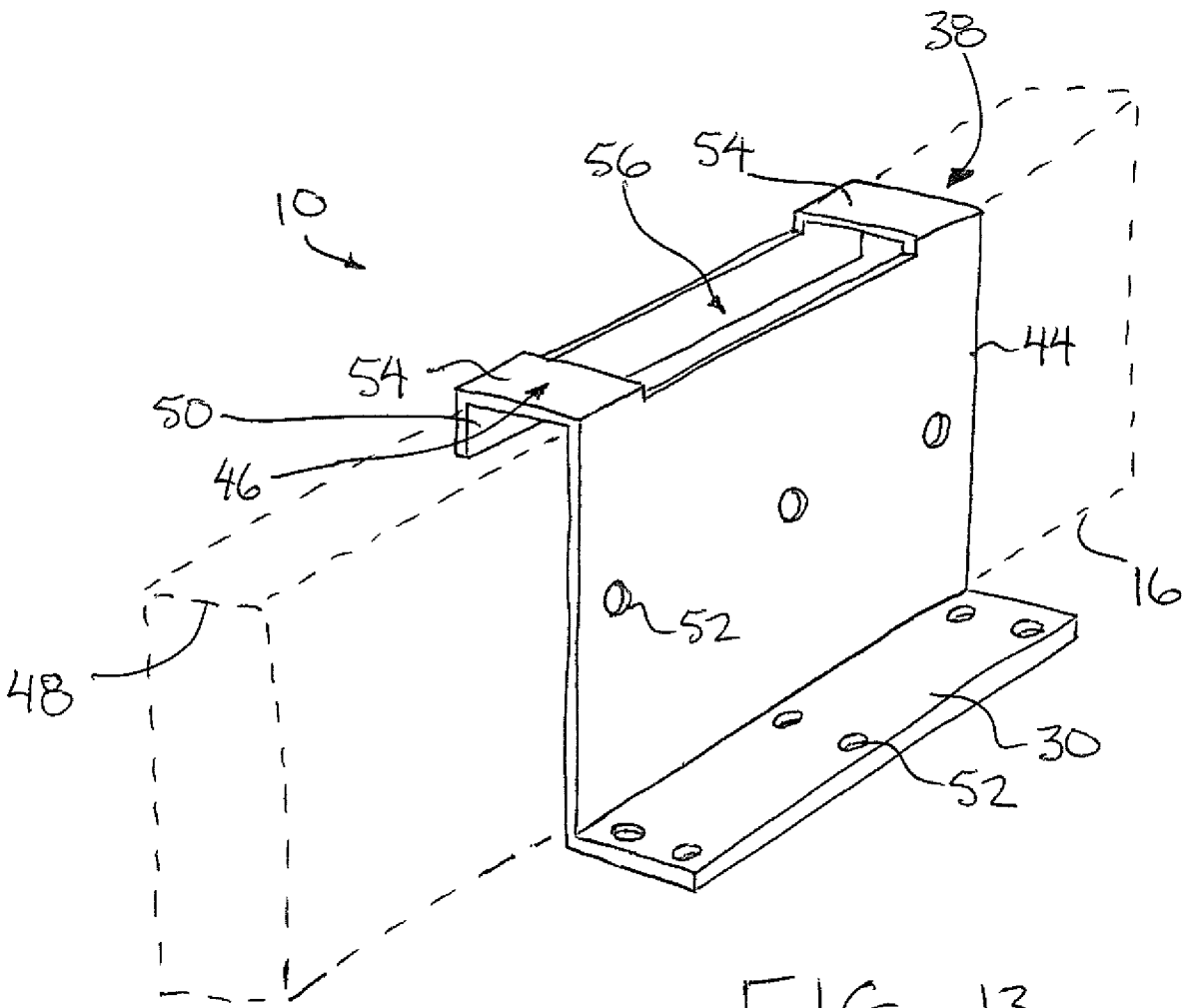
FIG. 13 is a perspective view of a second embodiment of the retrofit mounting clip.
Figure 14:
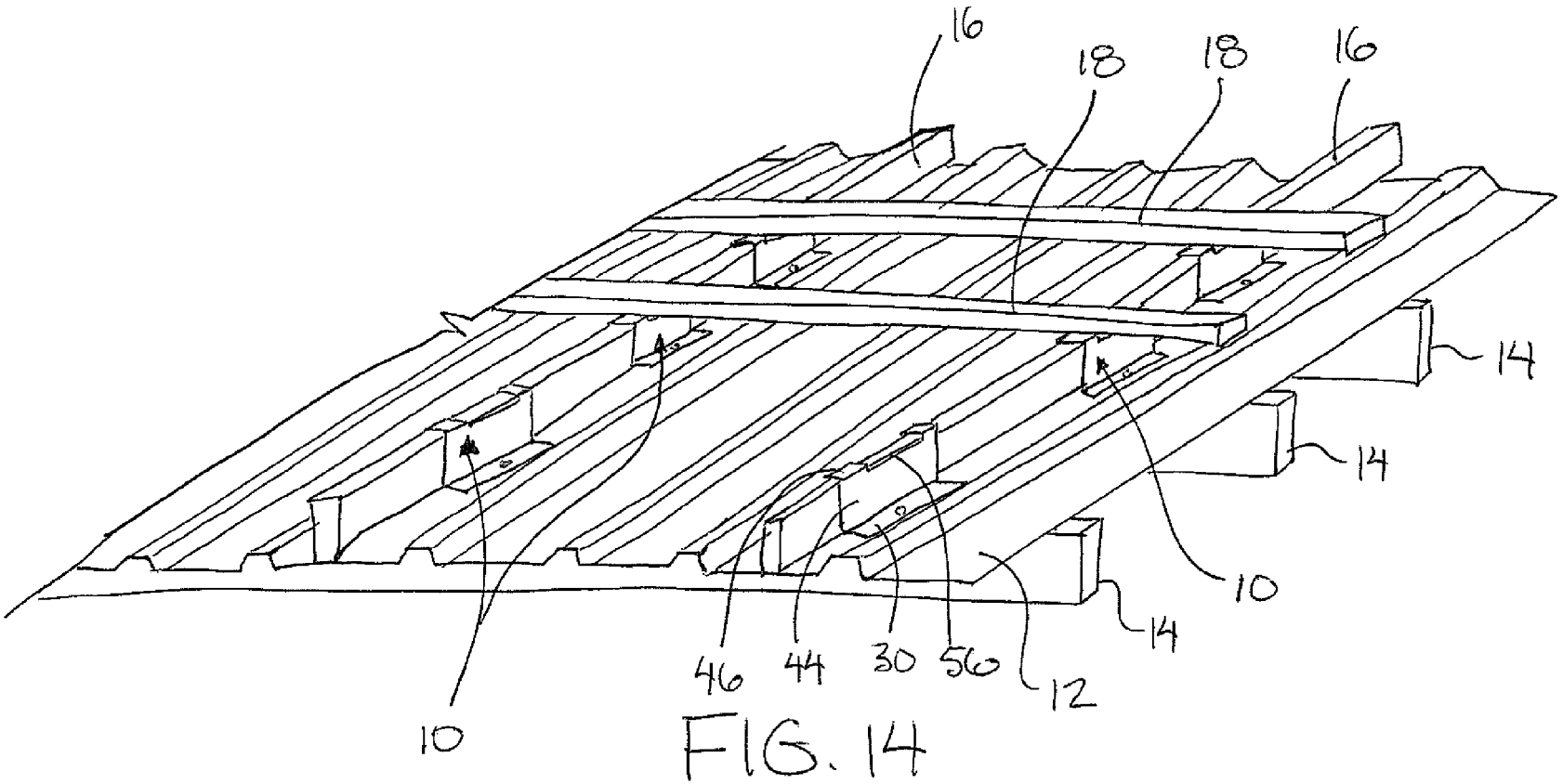
FIG. 14 is a schematic representation of the clips according to FIG. 13 installed over an existing standing seam roof of a building.

Alternatively, when less insulation space is required, a second embodiment of the mounting clip as shown in FIGS. 13 and 14 may be used. The clip as shown in FIG. 14 is mounted in a similar configuration to the installation of FIG. 3 in which a plurality of clips are mounted in an array at spaced apart positions along main structural members 14 of the building.

In the example of FIG. 14, the clips are mounted at spaced apart positions along the purlins 14 of an existing standing seam roof by fastening through the exterior surface material 12 forming the standing seam roof surface.

Primary wooden structural members 16 are then mounted across respective rows of the clips 10 such that the clips are located at spaced apart positions along respective ones of the primary members 16. The primary members 16 lie in a common plane and permit a layer of secondary wooden structural members 18 to be mounted perpendicularly thereacross such that each secondary member 18 is parallel to and aligned with a respective one of the purlins.

A first layer of insulation can thus extend longitudinally with the primary members to fill the gaps between the primary members 16 while a secondary layer of insulation can be located within the spaces between adjacent secondary members 18 extending perpendicularly to the insulation orientation of the primary members.

Typically, the secondary members 18 are fastened to each primary member across which is lays by direct wood to wood contact with suitable wood screws fastened therebetween. Appropriate roofing materials such as sheathing or standing seam roofing material can then be mounted across the secondary members 18 which provide the function of the original purlins for supporting the new replacement roofing material thereon.

As shown in FIGS. 13 and 14 each clip in this instance eliminates the standing portion 22 of the previous embodiment and instead provides only the channel portion 38 connected directly to the base portion 30. The base portion in this instance comprises a single flange with multiple fastener apertures 52 located therein to mount at various locations flat against an existing supporting surface of the building. Various patterns of apertures 52 may be provided in the base portion for alignment with different types of structural members or for different pull out resistance forces to resist wind up lift.

The channel 38 in this instance similarly comprises a connecting flange 44 oriented perpendicularly to the mounting flange of the base portion to extend outward from the building surface perpendicularly to the base flange.

Also as in the previous embodiment, the channel portion includes a hook flange 46 defined as two side flanges 54 with an opening 56 therebetween. The two flanges 54 of the hook flange lie in a common plane and project perpendicularly outward from the top end of the connecting flange 44 parallel to the base portion 30 but in the opposing direction from the connecting flange. The outer end flange 50 is also again provided for connecting between the two side flanges 54 of the hook flange.

The height of the connecting flange between the hook flange and the base flange corresponds approximately to the height of the dimensioned lumber with which the clip is designed to be used. The clip can accordingly be made available in multiple different sizes, for example accommodating the larger width of conventional 2×4, 2×6, 2×8 or 2×10 lumber for example. Similarly, the end flange 50 is spaced apart from the connecting flange 44 by the width of the hook flange so as to correspond to the width of the dimensioned lumber received therein which typically comprises the narrower dimension such that the lumber is mounted in an upright orientation when it is matingly received within the channel of the clip.

By providing the base portion extending away from the connecting flange opposite the hook flange, the structural member 16 can be first mounted in position with the mounting clips being subsequently inserted overtop of the outer edge 48 such that the inner end flange abuts the outer edge. The connecting flange 44 is sized such that the base portion 30 abuts the exterior surface against which the primary structural member is supported when the hook flange abuts the outer edge 48 of the member. Access is also provided to the fastener apertures in the mounting flange defining the base portion 30 to permit fasteners to be penetrated through the fastener apertures and into the main structural members of the building therebelow after the primary structural members are already in their final mounted position.

Additional fastener apertures 52 are provided in the connecting flange to permit conventional wood screws to be penetrated from the outer side of the connecting flange through the aperture and into the lumber material to retain the lumber in snug engagement within the channel 38. The clip 10 however already snugly retains the top end of the lumber between the end flange 50 and the connecting flange 44 while snugly retaining the lumber in the other direction between the hook flange 46 and the surface material against which the base portion 30 is fastened.

Similarly to the previous embodiments, the opening 56 centrally located between the two side flanges at the hook flange 46 is arranged such that the two opposed edges of the opening formed by the end flange 50 and the connecting flange 44 are again recessed relative to the side flanges 54 towards the base portion such that when a secondary wooden structural member is laid across perpendicularly to the primary member 16 received within the clip, direct wood to wood contact between the structural members is permitted. The space between the two side flanges 54 defining the length of the opening 56 is also suitably sized to be much greater than the width of the lumber intended to be received therein such that some minor misalignments of a plurality of clips within a common row of a secondary structural member 18 is permitted while maintaining direct wood to wood contact of the secondary member with each primary member across which it lays.

Alternatively, the clips of FIG. 13 may be secured to an existing wall comprising studs 14 with exterior surface material 12 in which the clips are fastened through the exterior surface material and into the studs such that the primary members are vertical alongside respective studs.

In further wall arrangements, the wall may comprise horizontal strapping members laying across the studs to define the structural members 14 supporting exterior surface material 12 thereon in the form of siding with vertically extending corrugations. The clips in this instance are fastened through the siding and into the horizontal strapping members. The clips are oriented to support the primary structural members 16 in a vertical orientation parallel to the corrugations in the siding similar to a standing seam roof application as described above. An array of secondary structural members 18 may then be supported perpendicularly to the primary members 16 by alignment with the openings in the respective hook portions to permit direct wood to wood contact and direct fastening with wood screws between the primary and second members at each intersection thereof. The secondary members 18 thus define horizontally oriented strapping members to support a new layer of exterior surface material in a conventional manner thereon such as vertically corrugated siding material.

Figure 15:
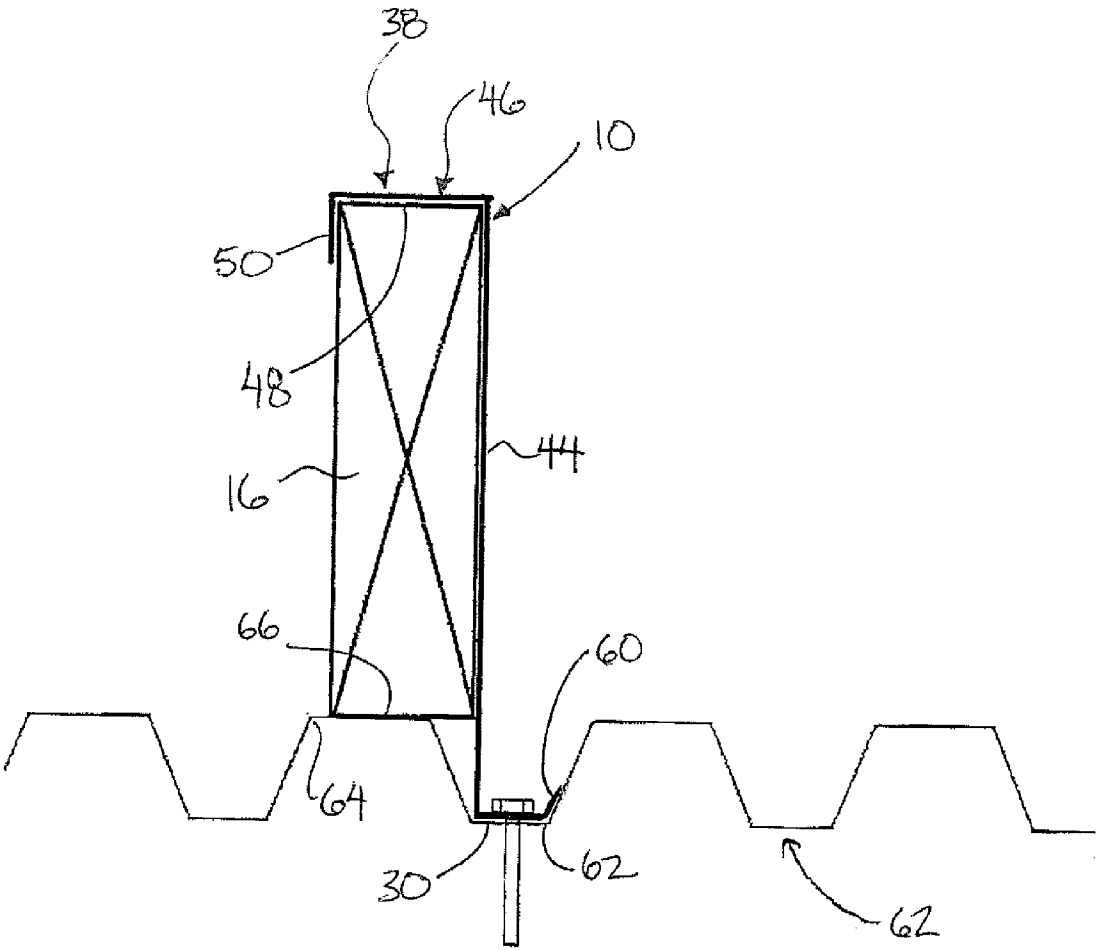
FIG. 15 is an end elevational view of a further embodiment of the mounting clip.

Turning now to FIG. 15, a further embodiment of the mounting clip 10 is shown in which the clip is substantially identical to the previous embodiment with regard to the flanges 54 and opening 56 of the hook portion 46, and the end flange 50. The base flange 30 in this instance however, may be narrower in width between the connecting flange 44 and the opposing free edge by folding an edge portion 60 upwardly towards the hook portion. This base flange configuration is particularly suited for connection at the trough portion 62 of exterior surface material 12 comprising corrugated sheet metal for standing seam roofs or siding in which the trough portion is near to or less than a width of the raised corrugated portion 64 and the primary structural member is aligned with the raised corrugated portion of the material.

In this instance, the connecting flange 44 in the embodiment of FIG. 15 also differs from the previous embodiment by its overall height between the hook portion and the base portion of the clip. As shown in FIG. 15, the height of the connecting portion 44 corresponds to a combined height of the primary structural member 16 and the height of the raised corrugated portion 64 relative to the trough portion 62 of the exterior surface material so that the inner edge 66 of the primary structural member is abutted snugly against the apex of the raised portion 64 when the hook portion of the clip abuts the outer edge 48 and the member 16 is mated with the channel.

As described herein, the present invention relates to a manner of retrofitting roofing and siding on new and existing buildings with an easy way of building over any surface. Right now the methods concentrate on all metal or all wood and the way of fastening them to the existing buildings are sub-standard. Also, the union between the existing building and the new retrofit is difficult and awkward to attach and work with. Alternatively, the present invention is a solution to join the two together in a simple and easy way that is less expensive than anything existing. Some of the retrofits, like flat roofing over metal roofing is very substandard and no real secure way is available until now. Contractors attempt to make something to do the job and have to get engineers approval for different applications with no real products on the market to do all the different applications.

In one example of building over a concrete building, the roof of the building is cement and a vapour barrier with some form of insulation and then standing seam roof is required. Pricing of the available prior art retrofit systems were found to be about $1.60 per sq ft. The prior art is all metal systems that requires fasteners from metal to metal which brings the cost up. The fasteners to the cement are the same.

The uniqueness of the present invention is the way it combines wood to metal then to the structure beneath which could be cement, metal, or wood. By joining the wood to uprights and then to the existing building simplifies the work and makes for a strong connection. The metal clip 10 is designed to make attaching wood substrate to any type of building product. Before it was difficult to build up any distance between the wall or roof and hold a two by four or two by six and then attach wooden purlins, then metal siding, or roofing or plywood and then siding or flat roofing, or torch down roofing. There are some metal clips made to attach wood to but they are made so you have to put a screw directly into the wood and then into the metal making them acceptable to screws backing out or spitting the wood by going too far into the wood thus making it a questionable structure they might fall with wind pull up. The present clip however gives the two by four a place to rest in while the upper purlin gets placed into a special cut out area that when it is attached together with deck screws it draws the two tight to the top of the clip making it a stronger system that would stand up to high winds. It also keeps the purlin even on the top, not sagging like most applications now done. Because any commercial systems out there are costly most build ups get silly in there design and fail with time. The average cost of the present invention can be $0.50 per sq ft compared to $1.60 for the closest competing products.

The uniqueness of this clip is the way it locks the two by four together or two by six's together and the snap in application of the first two by fours This is done when you slide the two bye four up against the top and then by using a lining bar you put it in the lining hole 1 and simply snap the two by four into is final resting place. This holds the two by four in place and allows the worker to use nails 2 to make the board non-movable.

When trying to attach wood to metal, roofers tend to use screws through the wood and into the metal roofing which is light gauge and doesn't provide enough strength for a good pull out. And when they do attach it to the Zs, roofers end up with air gaps and non uniformed application. It is also big on workers being careful and installing all the pieces right. Workmanship is the main reasons for failure in most insurance claims when the roof comes off the structure. The system of the present invention is worker friendly and easy to apply. The clip allows the wood to wrap itself around when screwed together with cheaper deck screws 3. It clamps itself to the clip holder which ties it to the structure via the screws 4 which hold it down. Once again to fasten the wood to the clips holders one doesn't need any costly self tapping metal screws or wood to metal screws which cost more. Speed, cost, and ease are what makes this system stand out from the rest. The sizes of stand offs and gages of steel would vary from job application to different job application. It could be from a retrofit roof to retrofit siding to interior building application like false ceilings or interior walls or insulating basement walls. Alternative uses are for holding off decorative facade to placing signs on outside walls holding boards in place, or to cover over duck work in a basement. Any where you want to put a board and hold it with strength.

The type of systems that can be done with this system:

Metal over Cement: or flat roofing over cement. The present system offers an easy way of covering a cement roof with a well insulated roof with metal or fiat being installed on top. With a ten and a half inch clip one can achieve R 40 values which are going to be standard in the new future with changes to the building code and restrictions being applied to the building industries.

Flat roofing over Metal: Stabilising tabs 5 to prevent the clips from sideward movement. With the fact wood is on the edges makes finishing of the sides and the bottom of the roof much easier and making the fastening of eaves trough easier and the side flashing straight and flush. All flat roofers have no real way of installing their roof over batted insulation over cement or metal roofs. Some of their ways are substandard and very susceptible to back out of screws and wind uplift, poor vapour barrier condensations due to air gaps, etc. They have to have plywood on top so they need purlins every 2 ft or less 6 which is something that can be done with ease with the present system.

Steel over Steel application: first one of the key advantages of this system is the ability to put additional purlins between the existing buildings purlins spaces which are usually five feet apart. By having the two by fours on edge running up the roof enables you to put additional purling on to be able to take on different structures like ply wood or lighter gage metal roofing. Also the way the present system works they can use lower standing seam which costs less and lowers cost of insulation. When comparing blanket to Styrofoam you would need 8 inches of Styrofoam insulation to equal 12 inches of R40 blanket insulation representing a cost savings of $5.80 per sq ft which is an incredible savings of 116,000.00 on a 20000 sq ft building.

Enveloping a building Siding and Roofing: This separates the outside wall and extends it out causing a void between the outside of the building and the structure itself where one can put bat insulation or leave as a void to heat and thus provides heat for the complete structure instead of heating all the air in the structure. Thus the main heating and cooling units job is to provide clean air to the inside after the envelope is installed.

Facades: on the outside of buildings, store fronts and for hanging decorative mouldings, signs, lights, curtain walls, double skin facade (Solar Heat). In the instance of solar heating, the present system covers the south side of the building with clear plastic or glass and the back side of the building with a double skin with R 20 and then circulating the air flow you would create a great solar house. The stand off system of the present provides a great thermal break that would provide a void to circulate the air.

Basement renovations: when doing a basement renovation, one must attach the wall to the cement somehow. First the standoffs can be attached with cement fasteners and then the boards fastened to them with the insulation applied in between. Then strapping, the vapour barrier and then drywall would complete the interior surface.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A building surface system in combination with a building having an exterior portion including a plurality of main structural members spanning parallel and spaced apart from one another and a supporting surface spanning an outer side of the main structural members, the building surface system comprising:

a plurality of wooden structural members of dimensional lumber;

a plurality of mounting clips comprising:

a base portion including at least one mounting flange fastened to a respective one of the main structural members through the supporting surface of the exterior portion of the building such that the mounting clips are supported in an array in which the clips are spaced apart longitudinally in rows such that each row is mounted along a respective main structural member of the exterior portion of the building and such that the rows are parallel and spaced apart laterally relative to one another; and a channel portion supported on the base portion and matingly receiving a portion of a respective wooden structural member therein such that the wooden structural members are parallel and spaced apart from one another in a substantially common plane spanning the supporting surface of the exterior portion of the building.

2. The system according to claim 1 wherein the channel portion comprises a hook portion oriented substantially parallel to the base portion at a location spaced outwardly from the base portion so as to be arranged for abutment with an outer side of the wooden structural member when the wooden structural member is engaged within the channel portion.

3. The system according to claim 2 wherein the channel portion further comprises a connecting portion extending between the base portion and one side of the hook portion and an end portion extending inwardly from the other side of the hook portion so as to be arranged to receive the wooden structural member between the connecting portion and the end portion of the channel portion when the wooden structural member is engaged within the channel portion.

4. The system according to claim 1 wherein the channel portion includes fastener apertures formed therein so as to be arranged to receive fasteners extending therethrough into the wooden structural member.

5. The system according to claim 1 wherein the channel portion comprises a hook portion oriented substantially parallel to the base portion at a location spaced outwardly from the base portion so as to be arranged for abutment with an outer side of the wooden structural member and a connecting portion extending between the base portion and the hook portion and wherein the connecting portion includes fastener apertures formed therein so as to be arranged to receive fasteners extending therethrough into the wooden structural member.

6. The system according to claim 1 wherein the channel portion comprises a hook portion oriented substantially parallel to the base portion at a location spaced outwardly from the base portion so as to be arranged for abutment with an outer side of the wooden structural member, the hook portion comprising a pair of flanges which are spaced apart from one another to define an opening therebetween which is arranged to span a full width of a wooden structural member received in the channel portion.

7. The system according to claim 6 wherein the channel portion further comprises a connecting portion extending between the base portion and the hook portion to support the flanges spaced apart from one another and an end portion joined between the flanges spaced from the connecting portion so as to be arranged to receive the wooden structural member between the connecting portion and the end portion of the channel portion when the wooden structural member is engaged within the channel portion.

8. The system according to claim 6 wherein the channel portion further comprises a connecting portion extending between the base portion and one side of the hook portion and an end portion extending inwardly from the other side of the hook portion so as to be arranged to receive the wooden structural member between the connecting portion and the end portion of the channel portion, and wherein the connecting portion and the end portion include an outer edge forming a portion of a perimeter of the opening in the hook portion, the outer edges being recessed inwardly relative to the hook portion.

9. The system according to claim 1 wherein the supporting surface of the building comprises an exterior layer of a roof in which the main structural members comprise purlins of the roof, and wherein the base portion is fastened onto a respective one of the purlins through the exterior layer.

10. The system according to claim 9 wherein the wooden structural members received in the channel portions extend parallel to the purlins.

11. The system according to claim 9 wherein the wooden structural members received in the channel portions extend perpendicularly to the purlins.

12. The system according to claim 9 wherein the wooden structural members include a plurality of primary wooden structural members received in the channel portions of the plurality of mounting clips so as to be supported parallel and spaced apart from one another above the exterior roof layer and a plurality of secondary wooden structural members spanning perpendicularly across the primary wooden structural members.

13. The system according to claim 12 the channel portion of each clip includes a hook portion oriented substantially parallel to the base portion at a location spaced outwardly from the base portion so as to abut an outer side of the primary wooden structural member received therein, the hook portion comprising a pair of flanges which are spaced apart from one another to define an opening therebetween receiving one of the secondary wooden structural members therein such that the respective primary and secondary wooden structural members are fastened together in direct contact with one another.

14. The system according to claim 1 wherein the supporting surface of the building comprises an exterior layer of a wall in which the main structural members comprise vertical studs of the wall, and wherein the base portion is fastened onto a respective one of the studs through the exterior layer.

15. The system according to claim 14 wherein the wooden structural members received in the channel portions extend vertically so as to be parallel to the studs.

16. The system according to claim 1 wherein each clip further comprises a standing portion extending from the base portion outwardly and away from the supporting surface, the channel portion being coupled to the standing portion spaced outwardly from the base portion.

17. A method of supporting a retrofit exterior surface on a building comprising a plurality of main structural members spanning parallel and spaced apart from one another and an existing exterior surface spanning an outer side of the main structural members, the method including:

providing a plurality of mounting clips comprising:

a base portion including at least one mounting flange; and a channel portion supported on the base portion;

fastening the mounting flanges of the mounting clips through the existing exterior surface onto respective ones of the main structural members such that the channel portions project outwardly from the existing exterior surface of the building;

mounting a plurality of wooden structural members within the channel portions of the mounting clips such that the wooden structural members span parallel and spaced apart from one another in a substantially common plane spaced outwardly from the existing exterior surface of the building; and using the plurality of wooden structural members to support the retrofit exterior surface spanning the existing exterior surface of the building.

18. The method according to claim 17 further comprising laying rows of insulating between the wooden structural members.

19. A retrofit system in combination with a building having an exterior portion including a plurality of main structural members spanning parallel and spaced apart from one another, the retrofit system comprising:

a plurality of primary wooden structural members of dimensional lumber;

a plurality of mounting clips comprising:

a base portion including at least one mounting flange fastened to a respective one of the main structural members of the exterior portion of the building; and a channel portion supported on the base portion and matingly receiving a portion of a respective primary wooden structural member therein such that the primary wooden structural members are parallel and spaced apart from one another in a substantially common plane spanning the exterior portion of the building, the channel portion including a hook portion oriented substantially parallel to the base portion at a location spaced outwardly from the base portion so as to abut an outer side of the primary wooden structural member received therein; and a plurality of secondary wooden structural members spanning perpendicularly across the primary wooden structural members;

each hook portion defining an opening therein which receives a portion of a respective one of the secondary wooden structural members therein such that the respective primary and secondary wooden structural members intersecting at each mounting clip are fastened together in direct contact with one another.

20. The system according to claim 19 further comprising sheathing material mounted to span across the secondary wooden structural members and exterior finishing material supported on the sheathing material.

* * * * *